US011897643B2

(12) United States Patent
Bellman et al.

(10) Patent No.: US 11,897,643 B2
(45) Date of Patent: Feb. 13, 2024

(54) APPARATUS, SYSTEM, AND METHOD FOR MODIFIED ATMOSPHERE PACKAGING

(71) Applicant: Glup LLC, Denver, CO (US)

(72) Inventors: Christina Spencer Bellman, Miami, FL (US); Ryan Artale, Crested Butte, CO (US); Mark Soderberg, Conifer (TV); Thomas Andrew Trudel, Port St Lucie, FL (US)

(73) Assignee: Preservation Systems Inc., Boulder, CO (US)

( * ) Notice: Subject to any disclaimer, the term of this patent is extended or adjusted under 35 U.S.C. 154(b) by 186 days.

(21) Appl. No.: 17/368,011

(22) Filed: Jul. 6, 2021

(65) Prior Publication Data

US 2022/0002016 A1 Jan. 6, 2022

Related U.S. Application Data

(60) Provisional application No. 63/048,311, filed on Jul. 6, 2020.

(51) Int. Cl.

*B65B 31/04* (2006.01)
*B65B 57/00* (2006.01)
*B65D 81/20* (2006.01)

(52) U.S. Cl.

CPC ..... *B65B 31/041* (2013.01); *B65B 57/00* (2013.01); *B65D 81/2076* (2013.01)

(58) Field of Classification Search

CPC ..... B65B 31/02; B65B 31/041; B65B 57/00; B65D 81/2038; B65D 81/2076

See application file for complete search history.

(56) References Cited

U.S. PATENT DOCUMENTS 1,591,932 A * 7/1926 Young ..... B65D 81/2076 141/4
2,925,346 A 2/1960 Harper et al.
4,055,931 A * 11/1977 Myers ..... B65B 31/08 53/512
4,344,467 A * 8/1982 Lahde ..... B65B 31/04 141/367
4,475,576 A 10/1984 Simon
4,702,396 A 10/1987 Gwiazda
4,889,250 A 12/1989 Beyer (Continued)

FOREIGN PATENT DOCUMENTS

DE 202004020529 U1 9/2005
DE 202004020529 U1 * 11/2005 ..... B65B 31/02

(Continued)

OTHER PUBLICATIONS

International Search Report and Written Opinion dated Oct. 25, 2021 issued in PCT/US21/40517.

*Primary Examiner* — Thomas M Wittenschlaeger
*Assistant Examiner* — David G Shutty
(74) *Attorney, Agent, or Firm* — Kubota & Basol LLP

(57) ABSTRACT

The present invention pertains in general to an apparatus and method for the modification of atmosphere in the packaging of perishable items, such as food items, for increased longevity. Embodiments include apparatus and methods which provide a customizable mix of gasses dependent upon the food being stored, and process for the monitoring of estimated pressurized gas canisters remaining within a vessel providing pressurized gasses.

19 Claims, 12 Drawing Sheets

SECTION A–A

(56) References Cited

U.S. PATENT DOCUMENTS 5,566,730 A 10/1996 Liebmann, Jr.
5,794,408 A * 8/1998 Patouraux ..... B32B 27/36 53/510
5,908,649 A 6/1999 Floyd et al.
6,185,913 B1 * 2/2001 Cappi ..... B65B 11/54 53/511
6,694,709 B2 2/2004 Takahashi et al.
7,575,770 B2 8/2009 Garwood
7,878,112 B2 * 2/2011 Naylor ..... B65D 81/2076 99/473
8,020,360 B2 * 9/2011 Biotti ..... F25C 5/182 62/331
8,276,616 B2 * 10/2012 Wright ..... F16K 15/147 137/846
8,371,478 B2 2/2013 Sommerfield et al.
8,925,756 B2 1/2015 Tarapata et al.
9,708,114 B2 * 7/2017 Moon ..... B65D 81/2023
10,233,068 B2 3/2019 Bazoberry
2006/0016155 A1 * 1/2006 Oesterlein ..... B65B 31/02 53/510
2008/0170963 A1 7/2008 Cantrell
2011/0203222 A1 * 8/2011 Forngren ..... B65B 31/04 53/79
2014/0001205 A1 1/2014 Hodges et al.
2016/0366919 A1 12/2016 Greve
2016/0368634 A1 * 12/2016 Lee ..... A45D 34/00
2019/0084749 A1 * 3/2019 Lapidot ..... B65D 81/2038
2019/0177017 A1 * 6/2019 Scott ..... B65B 7/2857
2022/0002016 A1 * 1/2022 Bellman ..... B65B 57/00
2022/0410100 A1 * 12/2022 Donaghey ..... B01F 23/2361

FOREIGN PATENT DOCUMENTS

DE 112011105729 T5 * 7/2014 ..... B65D 81/2023
NL 9401444 A 4/1996

* cited by examiner

DETAIL E

DETAIL E

APPARATUS, SYSTEM, AND METHOD FOR MODIFIED ATMOSPHERE PACKAGING

CROSS REFERENCE TO REFERENCE TO RELATED APPLICATIONS

This application claims the benefit of U.S. Provisional Patent Application 63/048,311 entitled "APPARATUS, SYSTEM, AND METHOD FOR MODIFIED ATMOSPHERE PACKAGING" filed on Jul. 6, 2020, the entire contents of which are incorporated herein by reference in its entirety for all purposes.

FIELD OF THE INVENTION

The present invention pertains in general to an apparatus and method for the modification of atmosphere in the packaging of perishable items, such as food items, for increased longevity. Included herein are methods and process for the monitoring of estimated pressurized gas canisters remaining within a vessel providing pressurized gasses.

BACKGROUND OF THE INVENTION

The use of modified atmosphere packaging, commonly referred to as "MAP" in the food packaging industry, surrounds the modification of the atmosphere surrounding a product within a package. Modified atmosphere packaging surrounds actively or passively controlling or modifying the atmosphere, commonly for the purpose of extending the shelf life of perishable goods—particularly fresh food items.

Modified atmosphere packaging is used to prevent the growth of microorganisms, post-harvest metabolic activities of intact plant tissues, post-slaughter metabolic activities of animal tissues, deteriorative chemical reactions, including enzyme-catalyzed oxidative browning, oxidation of lipids, chemical changes associated with color degradation, autolysis of fish and loss of nutritive value of foods in general, moisture loss.

A particular practice in the use of modified atmosphere packaging and involves the practice of gas flushing, which is considered as active modified atmosphere packaging. Gas flushing involves the displacement of ambient oxygen with a desired gas or gaseous mixture. In certain scenarios nitrogen, an inert gas, is used to reduce oxidation and the resulting increased rate of spoilage due to oxidation. Oxidation can lead to discoloration, spoilage, flavor deterioration, and texture differences in certain perishable goods. As these effects of oxidation take place, the product is often no longer suitable for sale and results in a loss of potential value for a seller of such products. For such reasons, modified atmosphere packaging has been used in the food packaging industry for decades in food-packing and preparation of food items for sale to consumers.

Common MAP gasses include, but are not limited to nitrogen, carbon dioxide, argon, and oxygen. Under most conditions, Nitrogen is an inert gas and is used to exclude air and, in particular, oxygen from systems to prevent oxidation. It is also used as a balance gas (filler gas) to make up the difference in a gas mixture, to prevent the collapse of packs containing high-moisture and fat-containing foods, caused by the tendency of these foods to absorb carbon dioxide from the atmosphere. For modified atmosphere packaging of dried snack products 100% nitrogen is used to prevent oxidative rancidity.

Carbon dioxide ($CO_2$) inhibits the growth of most aerobic bacteria and molds. Generally speaking, the higher the level of $CO_2$ in the package, the longer the achievable shelf-life. However, $CO_2$ is readily absorbed by fats and water—therefore, most foods will absorb $CO_2$. Excess levels of $CO_2$ in MAP can cause flavor tainting, drip loss and pack collapse. It is important, therefore, that a balance is struck between the commercially desirable shelf-life of a product and the degree to which any negative effects can be tolerated. When $CO_2$ is required to control bacterial and mold growth, a minimum of 20% is recommended.

Argon is a gas with similar properties as nitrogen. It is a chemically inert, tasteless, odorless gas that is heavier than nitrogen and does not affect micro-organisms to any greater degree. It is claimed to inhibit enzymic activities, microbial growth and degradative chemical reactions and can be used in a controlled atmosphere to replace nitrogen in most applications. Its solubility (twice that of nitrogen) and certain molecular characteristics give it special properties for use with vegetables. Under certain conditions, it slows down metabolic reactions and reduces respiration.

Although oxygen is typically removed from a package because it causes oxidative deterioration of foods and is required for the growth of aerobic micro-organisms, it is sometimes desired to maintain a certain level of oxygen for the freshness or color of perishable products. Oxygen is added to packaging in certain scenarios to maintain fresh, natural color (in red meats for example), to maintain respiration in fruits and vegetables, and to inhibit the growth of aerobic organisms such as in some fish and vegetables.

The practice of gas flushing can be performed in a single-stage or two-stage process. A single-stage gas flushing process typically involves injecting a gas mixture into the package such that the gasses replace a majority of the oxygen levels within the package and resulting in a residual oxygen level of between 2-5% within the package. In contrast, a two-stage process first applies a negative pressure to evacuate a majority of air contained within the package prior to replacing it with an injection of a desired gas or gas mixture. Thus, a two-stage MAP process using a similar amount of injected gas mixture typically results in lower residual oxygen levels than a single-stage MAP process. Furthermore, a two-stage MAP process requires less gas to backfill the package than the single-stage MAP process. Alternatively, certain processes employ the use of only a negative pressure to evacuate ambient air from within the package, leaving the packaged item under maintained negative pressure environment.

Regardless of whether vacuum or gas flush packaging is used to create a modified atmosphere, the package itself must provide a barrier to permeation over the expected shelf life, otherwise the beneficial effects of reducing oxygen are lost.

A problem surrounding the use of pressurized gas canisters surrounds the decreasing pressure of gasses held within the canister as the canister is depleted. Depletion of the canister results in lower pressures, and thus lower volumes of gasses dispensed for equivalent dispensing intervals. Accordingly, a dispensing interval from a newly installed gas-filled canister will dispense more gaseous volume than an equivalent length dispensing interval from a half-depleted gas-filled canister.

Although steps have been taken in the field of food packaging to prolong the freshness and salability of perishable products from the grower/producer to the sale to the consumer, there exist few options available to consumers to enable the prolonging of food freshness after sale to the consumer. Therefore, there are intrinsic needs surrounding the storage and prolonging of freshness of perishable products as well as the monitoring of gas content remaining within a partially depleted gas-filled canister in order to provide a consistent and repeatable delivery of gasses in a modified atmosphere packaging solution.

SUMMARY OF THE INVENTION

The present invention surrounds a method and apparatus for modified atmosphere packaging (MAP) of products to increase the storage life of perishable products, particularly food products. Certain embodiments provide a compact form-factor which is accessible and usable by hand in a home kitchen or other non-industrial setting, while other embodiments provide an apparatus for use in a commercial setting such as in commercial kitchens and restaurants. It will be appreciated embodiments utilizing methods such as vacuum packaging, a two-stage method of removing air from within a sealed container and back-filling the container with a gas, and gas flushing are within the spirit and scope of the present invention. It will be further appreciated that the use of "vacuum", and "negative pressure" herein are interchangeable as used in context with the present invention and application thereof.

Existing technologies provide modified atmosphere packaging through the use of form-fill-seal machines which form pouches, or thermoformed trays, from roll-stock which are then filled with product and heat-sealed.

Other existing technologies utilize chamber machines wherein a pouch or tray within a pouch is loaded into a chamber wherein a negative pressure is applied prior to backfilling the chamber with a desired gas and subsequently sealing the pouch.

Other existing technologies use what is commonly referred to as snorkel machines, named for a probe inserted within a large flexible bag containing the product for storage. The snorkel removes existing air prior to backfilling the pouch with a desired gas mixture.

A shortcoming of such technologies is the lack of reusability of the container. Although it is desirable to create form-fill-seal packaging for the sale of products, the general consumer may prefer a reusable and washable container which can be used repeatedly for a variety of perishable products.

A further shortcoming of the above discussed technologies surrounds the space associated with such machines. Such technologies are adapted for industrial processing of goods, and would not be appropriate for use in a home where space is limited.

It is an aspect of certain embodiments of the present invention to provide a container having a reusable base and lid which are configured to interconnect with a device wherein the device modifies the atmosphere within the container through the use of vacuum packaging, applying a vacuum and backfilling with a gas, or gas flushing.

It is an aspect of the present invention to provide a handheld modified atmosphere apparatus which allows a user to use modified atmosphere packaging in a household kitchen without the need of cumbersome or large equipment.

Some existing solutions such as U.S. Patent Publication No 2019/0084749 to Lapidot, filed Mar. 12, 2017 ("Lapidot")—herein incorporated in its entirety by reference for all purposes—provide a container wherein the container when sealed is placed atop a base, and the base when actuated applies a negative pressure to draw air from the container. Although such technologies provide a consumer level apparatus and method for providing modified atmosphere packaging, such technologies require dedicated countertop space. Furthermore, technologies such as disclosed by Lapidot do not provide the benefit of backfilling of a container with a gas following the vacuum process.

Certain technologies involve the use of a hand-actuated vacuum pump such as disclosed by U.S. Pat. No. 4,889,250 to Beyer ("Beyer"), filed Jun. 30, 1988—incorporated herein in its entirety by reference for all purposes. The hand-actuated pump is connected to one-way valve atop the container and actuated until a sufficient negative pressure exists within the container. Such technologies fail to provide a backfilling of gas to enhance and prolong the freshness of food products placed therein. Similar technologies exist having an electrically actuated pump which once again apply a vacuum within the container but do not backfill with a gas.

Certain existing solutions for the preservation of perishable goods involves the gas flushing of a container using a pressurized canister of gas wherein the gas is sprayed within the container—such as a wine bottle—to replace the ambient air within the container with the gas. Such technologies are often ineffective as they rely on the bulk replacement of ambient gasses and cannot ensure a repeatable low oxygen content without excessive application of the gas thereby limiting the supply of gasses available to the consumer. Furthermore, such embodiments fail to provide a sealing solutions thereby requiring additional equipment and or additional steps for the sealing of a container.

It is an aspect of certain embodiments of the present invention to allow the backfilling of a container with one or more gasses or a mixture thereof. Certain embodiments comprise a plurality of gas-filled canisters wherein the gas-filled canisters are interchangeable and replaceable.

It is an aspect of certain embodiments of the present invention to seal a container by applying a negative relative pressure within the container, wherein the negative relative pressure results in the engagement of the lid and creating a seal between the lid and the container.

It is an aspect of the present invention to provide a handheld modified atmosphere packaging apparatus which interconnects with a storage container such that the apparatus draws a vacuum within the container prior to backfilling the container with an appropriate gas. It is a further aspect that an apparatus of certain embodiments provides the capability to backfill a container with more than one inert gas based upon the perishable product being stored. Certain perishable goods remain usable for longer when different inert gasses are used. Certain perishable goods remain usable longest when a container is backfilled with nitrogen, others with carbon dioxide, others with argon, and others still using a combination thereof. It will be appreciated that the gasses used within the present invention are not limited to nitrogen, argon and carbon dioxide, and the use of any other gasses (inert or otherwise) known to those skilled in the art are within the spirit and scope of the present invention. Furthermore, the utility of the present invention can be applied to containers such as wine containers, baby food containers and baby food makers, and other containers while in keeping with the spirit and scope of the present invention.

It is an aspect of the present invention to monitor and estimate the remaining gasses held within a gas-filled canister such that the amount remaining can be estimated as a pressure, volume, or number of gas deliveries remaining for a particular size container intended for the storage of perishable items.

In certain embodiments, monitoring the delivery of gasses which are dispensed in short bursts while pulling a vacuum. Delivering gasses in short bursts while pulling vacuum at a constant rate provides indications as to how much gas is remaining within the gas-filled canister. By monitoring the gas remaining in the gas-filled canister in this manner, accurate sensors which are often cost prohibitive are unnecessary as the remaining gasses are calculated from trends in pressure within the food storage container.

In certain embodiments, the remaining gas in a gas-filled canister is calculated through the use of force sensors placed between the lobe of the cam and the spring-loaded follower such that the force required to depress the spring-loaded follower until gasses are dispensed is monitored. It will be appreciated by those skilled in the art that forces required to depress the spring-loaded follower will decrease as the pressures within the gas-filled canister decreases. Thus, a user can be alerted to a low-pressure threshold within the gas-filled canister when the forces required to depress the spring-loaded follower reach a predetermined threshold. Alternatively, a user can be alerted to a low-pressure threshold within the gas-filled canister when the forces required to depress the spring-loaded follower reach a predetermined fraction of the forces required to depress the spring-loaded follower when the gas-filled canister was initially installed anew. It will be appreciated that the above method can be accomplished through the installation of a force sensor placed within the actuating electro-mechanical motor. Although force sensors have been described herein as being placed between the lobe of the cam and the spring-loaded follower, it will be appreciated that alternative placements of force sensors to monitor forces required to dispense gasses are within the spirit and scope of the present invention.

In certain embodiments, the remaining gas in a gas-filled canister is calculated through monitoring the reaction force in the electro-mechanical motor used to drive the valve actuator. It will be appreciated that in order to overcome increased resistance, an electro-mechanical motor requires an increased level of electrical current to operate. Thus, the forces required to actuate the cam and thereby depress the spring-actuated follower can be calculated based upon the electrical input required by electro-mechanical motor to depress the spring actuated follower and dispense gasses. Accordingly, when the electrical current needed to dispense gasses drop to a predetermined threshold, a user can be notified of a low-pressure threshold within the gas-filled canister. Alternatively, when the electrical current needed to dispense gasses drop to a predetermined fraction of the current required to depress the dispense gasses when the gas-filled canister was initially installed anew.

In certain embodiments the remaining gas in a gas-filled canister is calculated through monitoring the number of step counts an electro-mechanical motor requires to deflect the spring-loaded follower until gas is dispensed. It will be appreciated by those skilled in the art that electrometrical motors such as stepper motors operate with a predetermined number of motor steps wherein each step equates to a predetermined angular displacement. Thus, the number of motor steps is directly associated with the angular displacement of a motor, and can be further translated to a linear displacement dependent upon the system within which it operates. It will be further appreciated that alternative electro-mechanical motors such as servo motors and step-servos allow the user to operate the motor at known angular displacements. As discussed herein, a "step" is associated with a predetermined angular interval and is not limited to a particular type of electro-mechanical motor. A larger number of motor steps results in a larger orifice for dispensing gas, and a smaller number of motor steps results in a smaller orifice for dispensing gas.

Due to gas flow characteristics, such as choked flow environments, it will be appreciated that the number of motor steps required for the dispensing of gas may not follow a linear progression as the gas within the gas-filled canister is expended. Explanations for such characteristics include a choked flow environment, but are not limited thereto.

Choked flow is a limiting condition where the mass flow will not increase with a further decrease in the downstream pressure environment for a fixed upstream pressure and temperature. For homogeneous fluids, the physical point at which the choking occurs for adiabatic conditions, is when the exit plane velocity is at sonic conditions; i.e., at a Mach number of 1. At choked flow, the mass flow rate can be increased only by increasing density upstream and at the choke point. The mass flow rate in a choked flow environment is independent of the downstream pressure, and depends only on the temperature and pressure and hence the density of the gas on the upstream side of the restriction.

Thus, in certain embodiments of the invention, the number of motor steps required to dispense a predetermined amount of gas over a predetermined timespan are nonlinear. As the gas-filled canister is depleted, the upstream pressure decreases, the choked-flow condition is released, and the system requires a higher number of motor steps to provide the desired amount of gas over a predetermined timespan. Thus, the number of motor steps required to overcome the choked flow environment increases linearly as the gas-filled canister nears the end of its capacity. In certain embodiments it is the monitoring of this linear increase of motor steps which indicates the remaining gasses within the gas-filled canister for dispensing. Accordingly, the system of certain embodiments records the number of motor steps required to dispense predetermined amount of gas over a predetermined amount of time. Each subsequent dispensing process recalls the number of motor steps required in the preceding dispensing of gas.

In certain embodiments, the monitoring of remaining gas within a gas-filled canister can be performed using the combination of linear springs disposed between the pin of a valve-actuator and an extension arm of a cam. Monitoring the number of motor steps required of an electro-mechanical motor. It will be appreciated that when the pressure within the gas-filled canister is high, the spring will compress and require a higher number of motor steps to dispense gasses from the canister. However, as the pressure within the gas-filled canister decreases, the spring is less compressed during the dispensing of gasses, and thus the electro-mechanical motor requires fewer motor steps to dispense gasses from within the gas-filled canister. Therefore, it will be appreciated by one skilled in the art that the monitoring of step count of the electro-mechanical motor can be used to monitor spring compression which directly relates to the gas pressure held within the gas-filled canister.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Figure 1B:
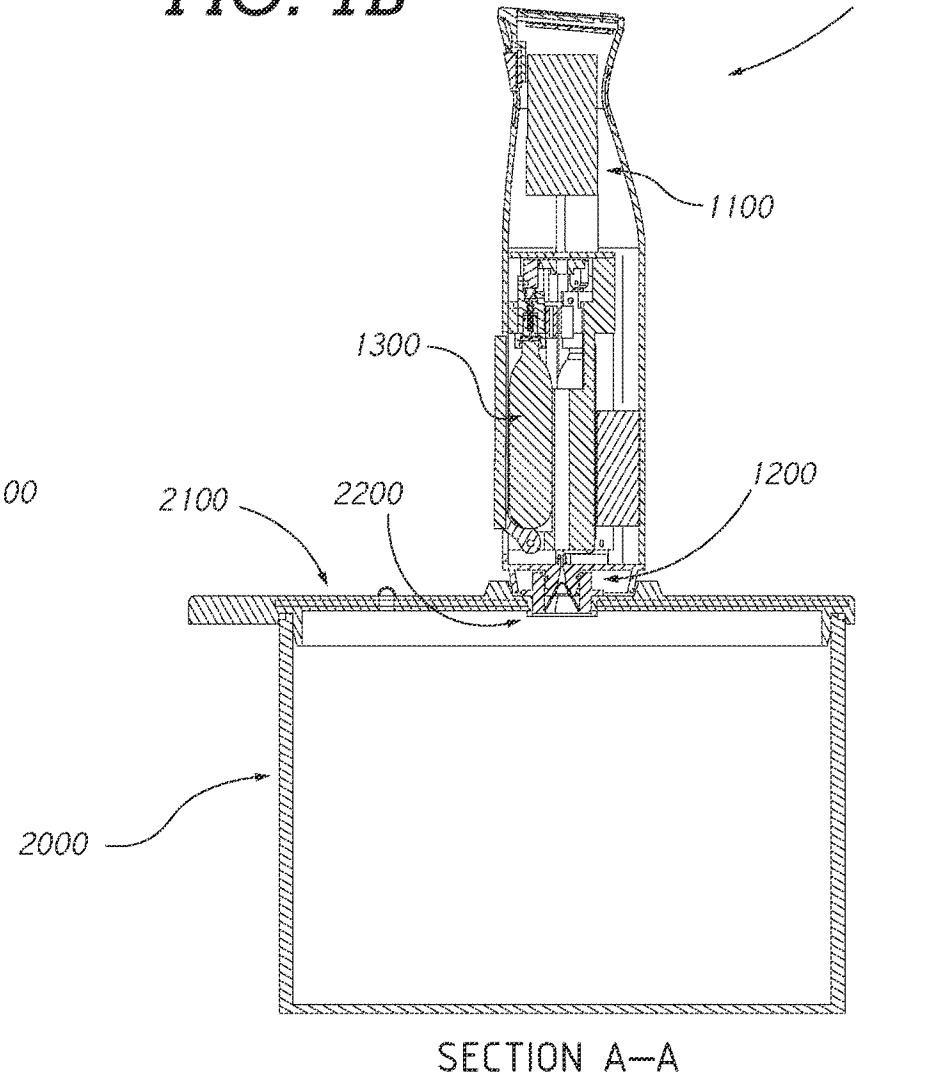
FIG. 1A—A front view of certain embodiments comprising an apparatus for modified atmosphere packaging FIG. 1B—A cross-sectional side view of certain embodiments shown in FIG. 1A FIG. 2A—A perspective of certain embodiments of an apparatus comprising a plurality of gas-filled canisters and a receiver comprising valves FIG. 2B—A side view of certain embodiments of an apparatus comprising a plurality of gas-filled canisters and a receiver comprising valves FIG. 2C—A cross-sectional view of certain embodiments of an apparatus comprising a plurality of gas-filled canisters and a receiver comprising valves FIG. 3A—A cross-sectional side view of certain embodiments comprising an apparatus for modified atmosphere packaging FIG. 3B—A cross-sectional detail view of certain embodiments shown in FIG. 3A FIG. 4A—A transparent side view of certain embodiments demonstrating the loading of a gas-filled canister FIG. 4B—A cross-sectional side view of certain embodiments showing a loaded gas-filled canister FIG. 4C—A detail view of certain embodiments shown in FIG. 4B FIG. 5A—A cross-sectional side view of certain embodiments of an apparatus for modified atmosphere packaging FIG. 5B—A detail view of certain embodiments of an apparatus for modified atmosphere packaging wherein the apparatus is not interconnected with the lid of a container FIG. 5C—A detail view of certain embodiments of an apparatus for modified atmosphere packaging wherein the apparatus is interconnected with the lid of a container FIG. 6—A perspective view of certain embodiments comprising an apparatus for modified atmosphere packaging FIG. 7—A representative system view of certain embodiments comprising an apparatus for modified atmosphere packaging FIG. 8—A representative view of a method for the operation of an apparatus for modified atmosphere packaging and the determination of the remaining gasses within a supplying gas-filled canister FIG. 9—A graphical view of certain embodiments showing pressures while determining remaining gasses within a supplying gas-filled canister FIG. 10—A graphical view of certain embodiments showing pressures while determining remaining gasses within a supplying gas-filled canister FIG. 11—A graphical view of certain embodiments showing electro-mechanical motor step count while determining remaining gasses within a supplying gas-filled canister
Figure 1A:
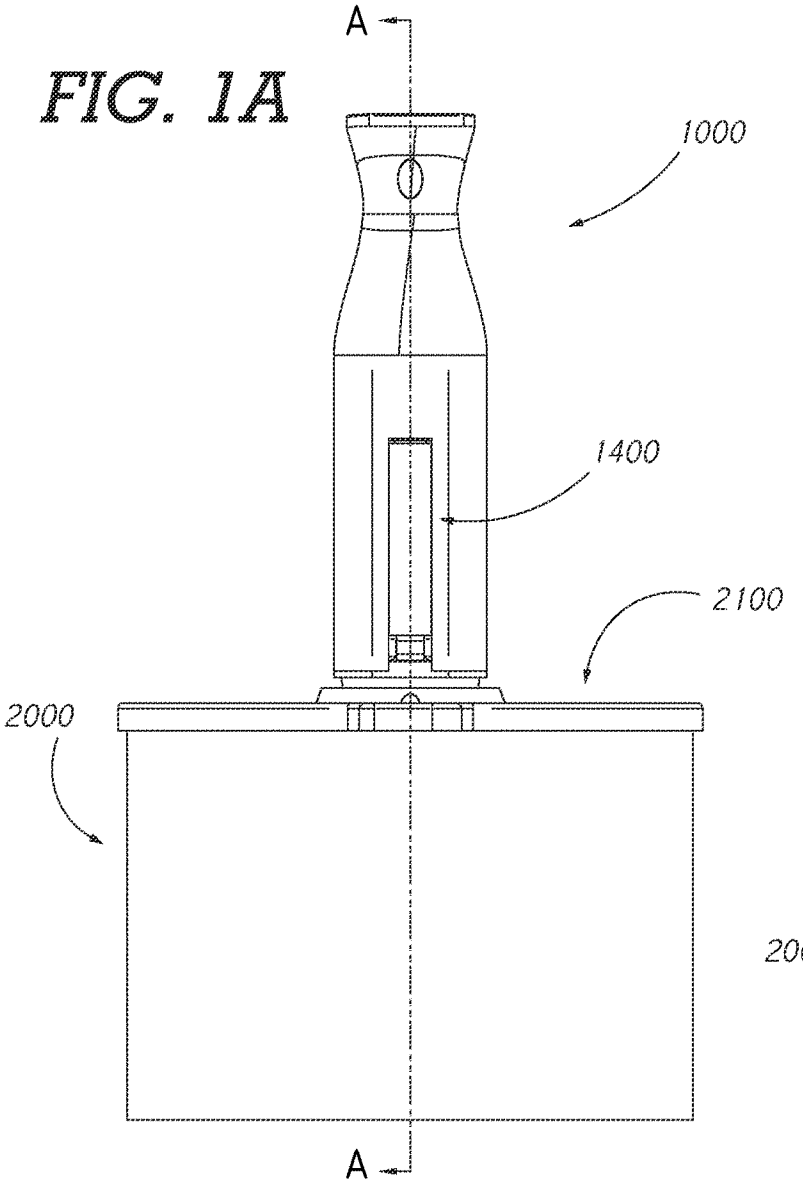

Certain embodiments, shown in FIG. 1A-FIG. 1B, of the present invention comprise an apparatus 1000 for modified atmosphere packaging having a vacuum pump 1100 interconnected with a port 1200 of the apparatus. The apparatus 1000 is configured to interconnect with a container 2000 wherein the lid 2100 of the container comprises a port 2200 configured to interconnect with the port 1200 of the apparatus. When the port 1200 of the apparatus is interconnected with the port 2200 of the lid, the actuation of the vacuum pump 1100 acts to draw air from within the container.

In certain embodiments, as seen in FIG. 1B, an apparatus 1000 comprises at least one gas-filled canister 1300 which is removably interconnected with the port 1200 of the apparatus. The apparatus 1000 is configured to interconnect with a lid 2100 of a container wherein the lid 2100 of the container comprises a port 2200 configured to interconnect with the port 1200 of the apparatus. When the port 1200 of the apparatus is interconnected with the port 2200 of the lid, the actuation of gas flow from the gas-filled canister 1300 acts to fill the container 2000 with gas from the gas-filled canister 1300.

Figures 2A, 2B, 2C:
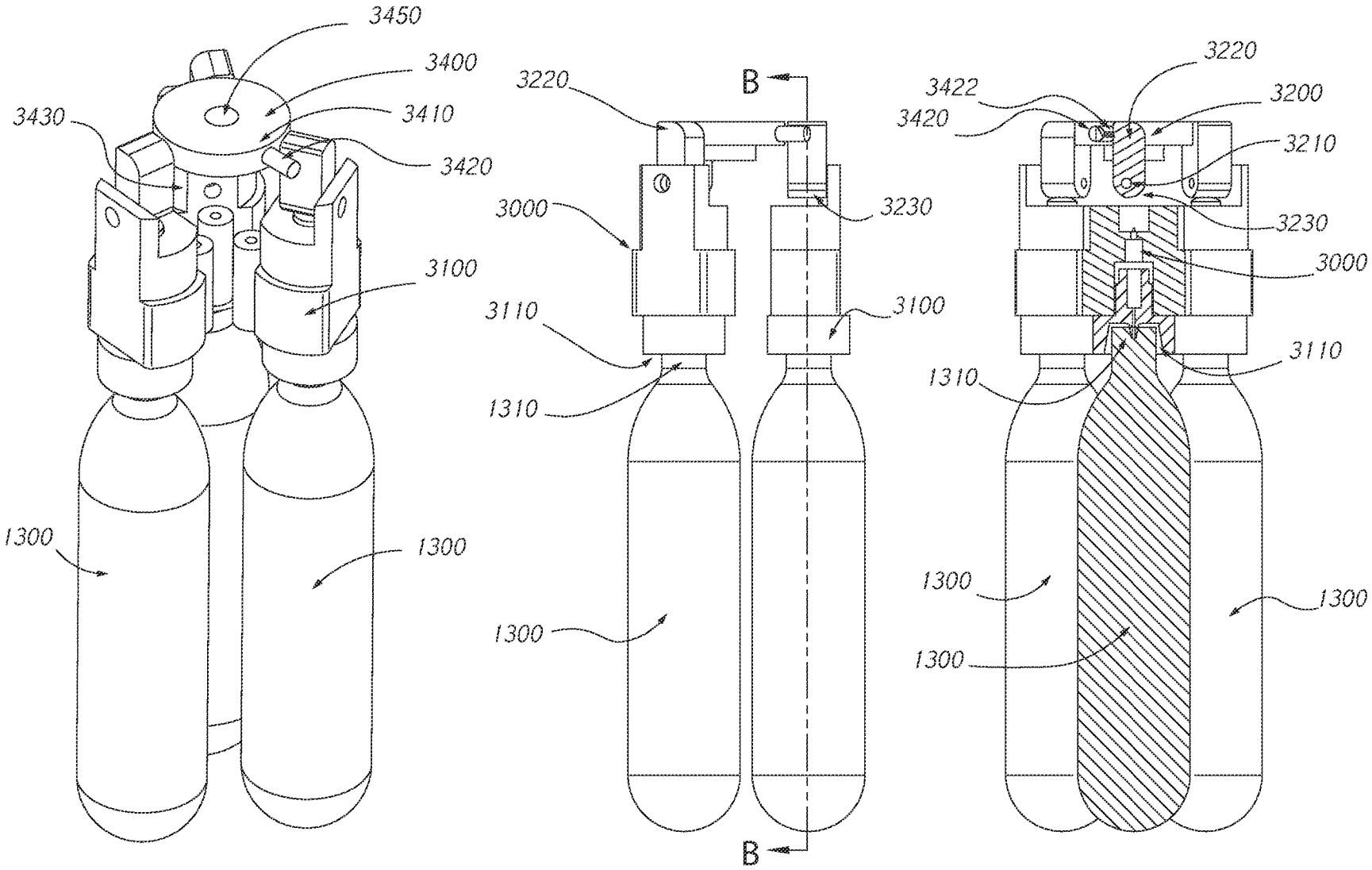
Figure 3B:
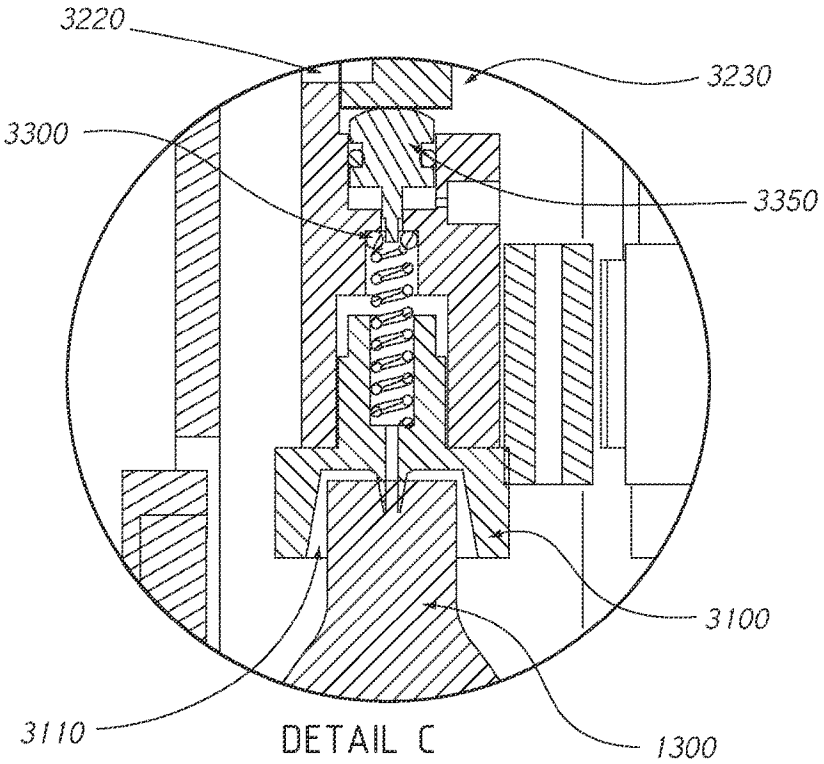
Figure 3A:
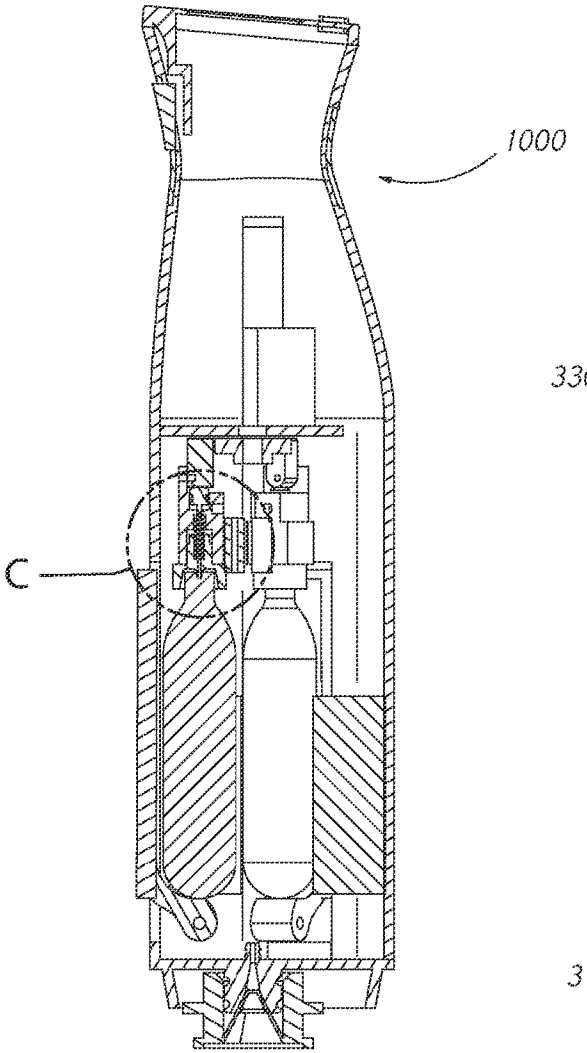

In certain embodiments, as shown in FIG. 2A-FIG. 2C for example, a gas-filled canister 1300 is inserted into a receptacle 1400 (FIG. 1A) of an apparatus 1000 with an outlet end 1310 of the gas canister interconnected with a valve 3000 which controls the actuation of gas flow from the gas-filled canister 1300. In certain embodiments, the valve 3000 further comprises a receiver 3100 having a recess 3110 wherein the outlet end 1310 of the gas-filled canister is inserted into the recess 3110, thereby interconnecting the gas-filled canister 1300 with the valve 3000. It will be appreciated that certain embodiments of the present invention comprising valves 3000 are configured to receive a threaded outlet end 1310 of a gas-filled canister 1300, and certain embodiments comprise valves 3000 configured to receive a non-threaded outlet end 1310 of a gas-filled canister are within the spirit and scope of the present invention. Certain embodiments comprise an apparatus having a plurality of gas-filled canisters 1300, each held within the apparatus 1000. It will be appreciated that gas-filled canisters 1300 having an outlet end 1310 comprising a threaded connection, a non-threaded connection, and alternate connectors known to those skilled in the art—such as disclosed in U.S. Pat. No. 8,925,756 to Tarapata et. al ("Tarapata") filed Aug. 8, 2012, which is incorporated by reference herein for all purposes—are in keeping with the spirit and scope of the present invention. Certain embodiments of the present invention comprise a plurality of gas-filled canisters. It will be appreciated that the plurality of gas-filled canisters 1300 of certain embodiments contain different gasses therein, while the gas-filled canisters of alternate embodiments contain the same gasses therein.

In certain embodiments the receiver 3100 comprises a plurality of recesses 3110 for receiving a gas-filled canister 1300, and further comprise a plurality of valves 3000 for controlling the release of gasses from the gas-filled canisters 1300.

In certain embodiments, shown in FIG. 2A-FIG. 3B for example, a valve 3000 configured to interconnect with a gas-filled canister 1300 comprises a release mechanism which, alternately seals the gas-filled canister 1300 and allows the flow of gas from the gas-filled canister 1300. In certain embodiments the valve 3000 comprises a cam 3200 constrained to the valve by a pivot 3210. The cam comprises an extension arm 3220 on a first side of the pivot 3210 and a lobe 3230 on the second side of the pivot. The lobe 3230 of the cam 3200 is configured to contact a valve-release 3300 wherein the rotation of the cam 3200 actuates the valve-release 3300 and releases gas from the gas-filled canister 1300. In certain embodiments the valve-release 3300 comprises a spring-loaded follower 3350 wherein the rotation of the cam 3200 introduces the lobe 3230 to depress the spring-loaded follower 3350 thereby actuating the valve-release 3300.

Certain embodiments of the present invention, shown in FIG. 2A-FIG. 3B for example, comprises a valve-actuator 3400 which allows the actuation of one or more valves 3000. In certain embodiments, when the valve-actuator 3400 is rotated, a distal end 3410 of the valve-actuator actuates the valve-release 3300 thereby releasing gas from a gas-filled canister 1300. In certain embodiments the valve-actuator 3400 comprises a pin 3420 which is configured to rotatively actuate about a pivot 3450 such that the pin 3420 contacts laterally, and actuates the cam 3200 of one or more valves selectively. In certain embodiments, the valve-actuator 3400 comprises a plurality of pins 3420. In certain embodiments, the plurality of pins 3420 are configured to simultaneously actuate multiple valves 3000. It will be appreciated that alternate embodiments comprises a valve-actuator 3400 which directly actuates the valve 3000, such as by depressing a valve release 3300 without the use of a cam 3200, is in keeping with the spirit and scope of the present invention. It will be appreciated by those skilled in the art that the valve actuator 3400 can be rotated by manual methods, or through the use of powered methods such as with an electro-mechanical motor 3430 while in keeping with the spirit and scope of the present invention.

Figure 4C:
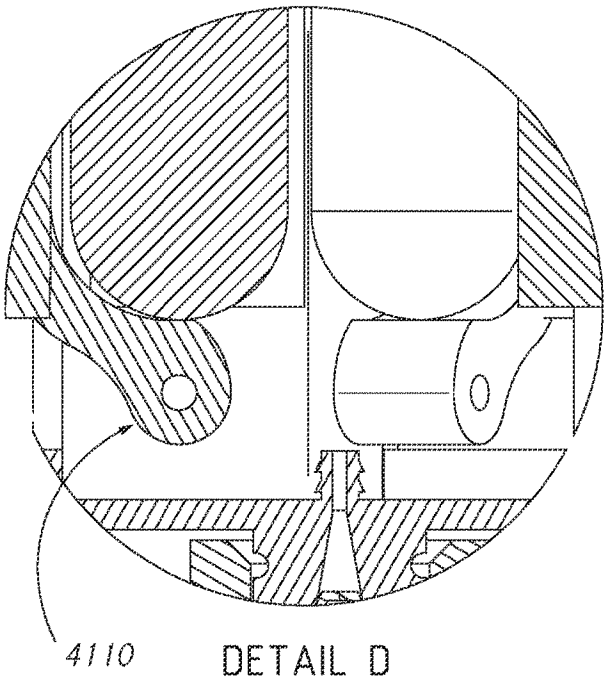
Figure 4B:
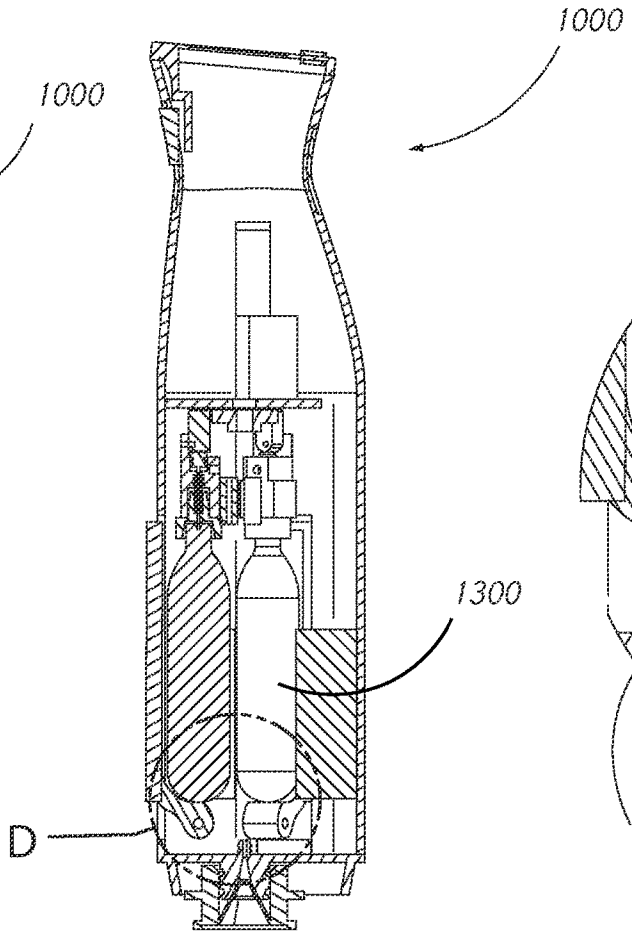
Figure 4A:
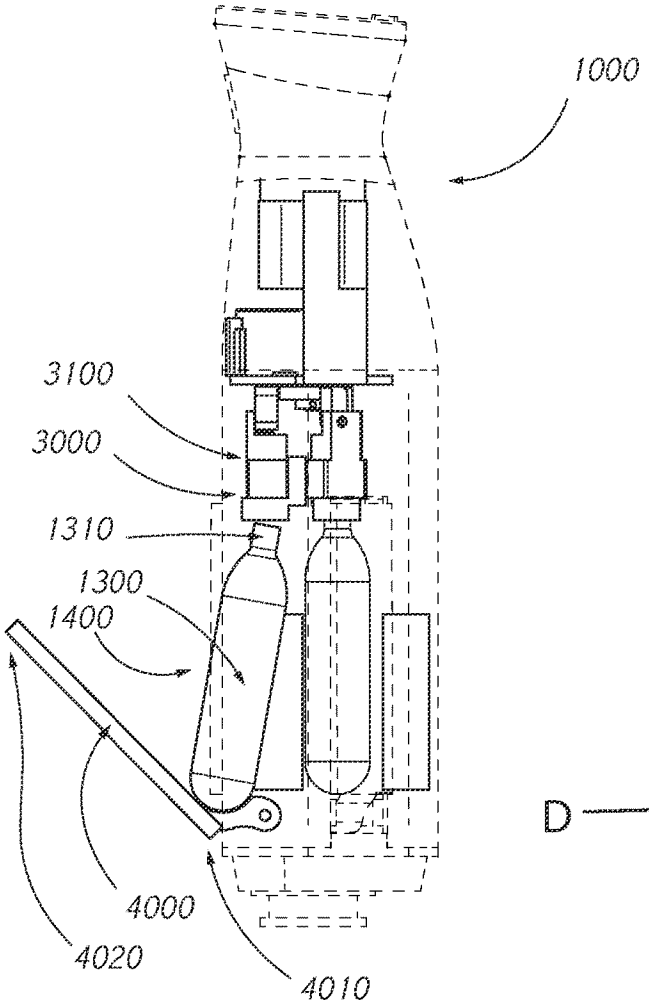

In certain embodiments, shown in FIG. 4A-FIG. 4C for example, a gas-filled canister 1300 having an outlet end 1310 and a closed end 1320 is inserted into a receptacle 1400 wherein the outlet end 1310 is directed toward a receiver 3100 having a recess configured to interconnect the outlet end of the gas-filled canister with a valve. In certain embodiments a door, having a hinged connection to the apparatus, is configured to receive a gas-filled canister and rotatably insert and constrain the gas-filled canister within the receptacle.

In certain embodiments, shown in FIG. 4A-FIG. 4C for example, a door 4000 is hingedly attached to an apparatus 1000 wherein the door 4000 rotatively opens to allow the insertion of the gas-filled canister 1300 into a receptacle 1400 of the apparatus. The first end 4010 of the door is hingedly attached to the apparatus 1000, and a second end 4020 of the door rotates open from the apparatus 1000 allowing the insertion of the gas-filled canister 1300 into the receptacle 1400. In certain embodiments the door 1300 comprises a cam 4100 on an internal aspect of the door wherein the closing of the door 4000 causes a lobe 4110 of the cam to push the outlet end 1320 of the gas-filled canister 1300 toward the recess 3100 resulting in the canister interconnecting with the recess 3100 and an associated valve 3000.

Figure 5A:
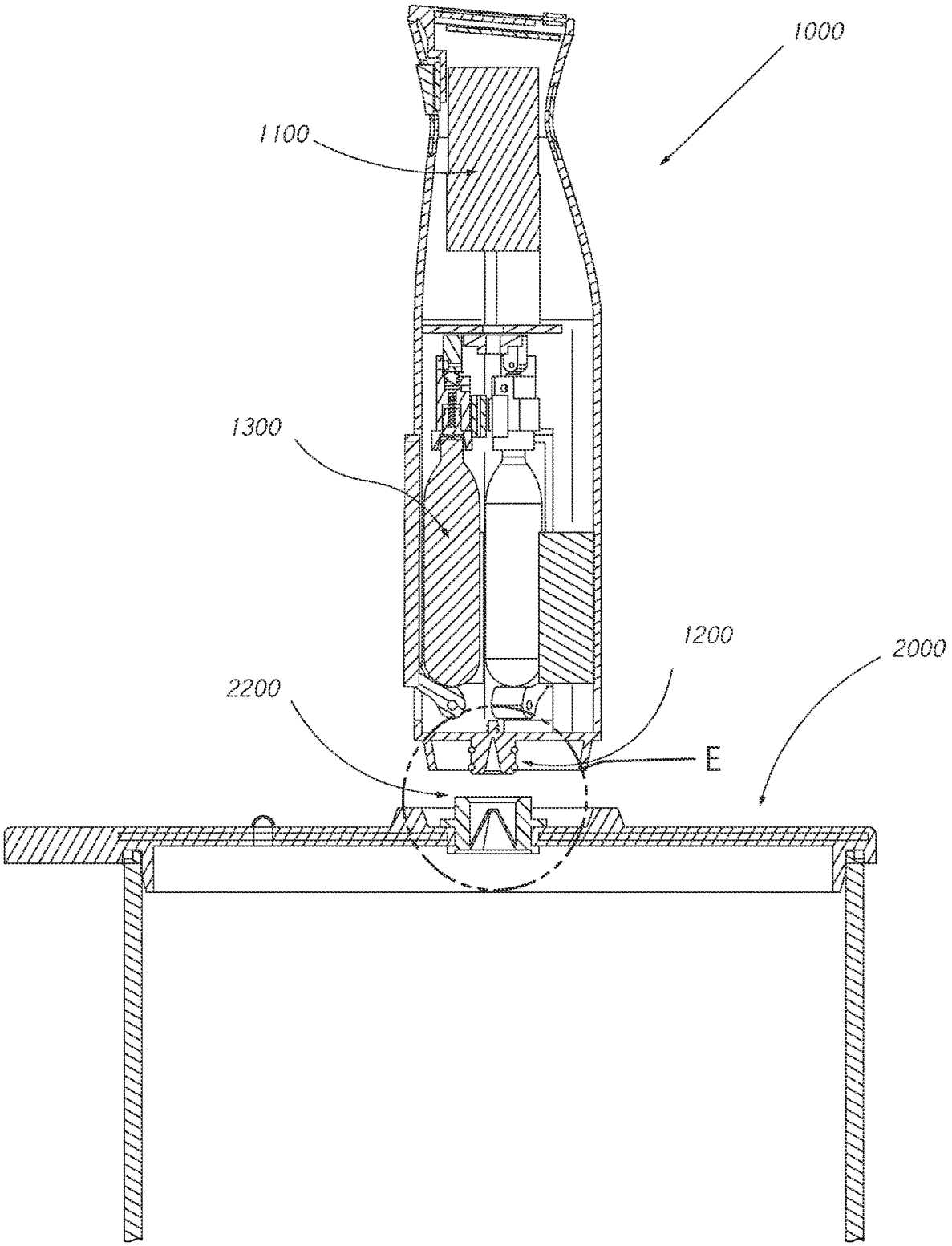
Figure 5B:
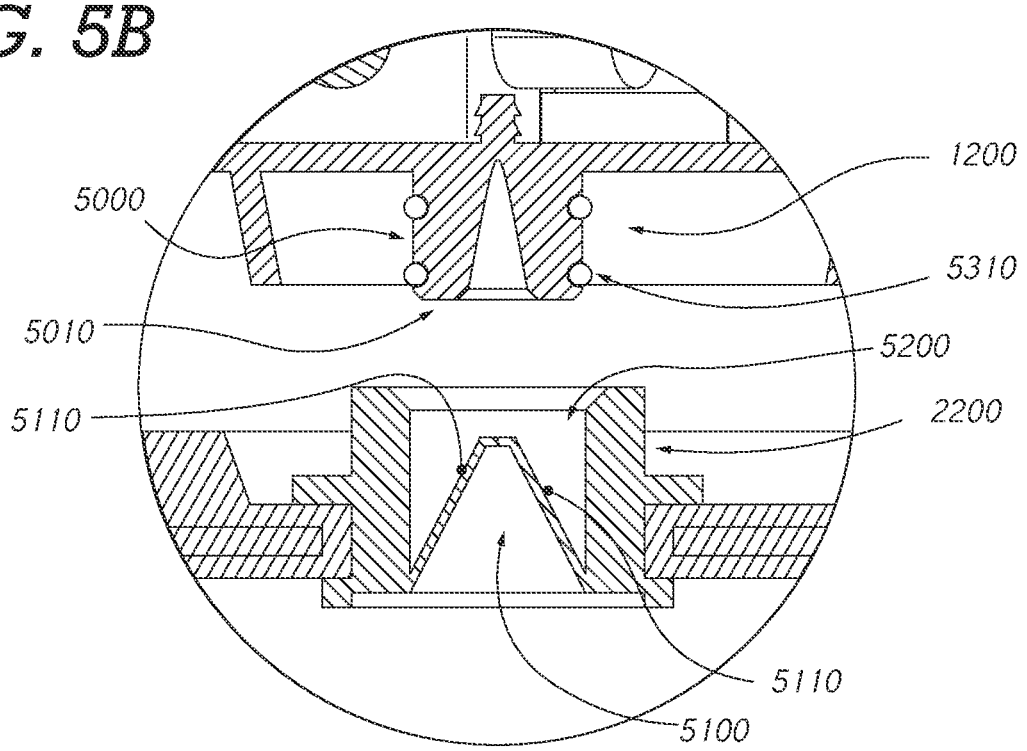
Figure 5C:
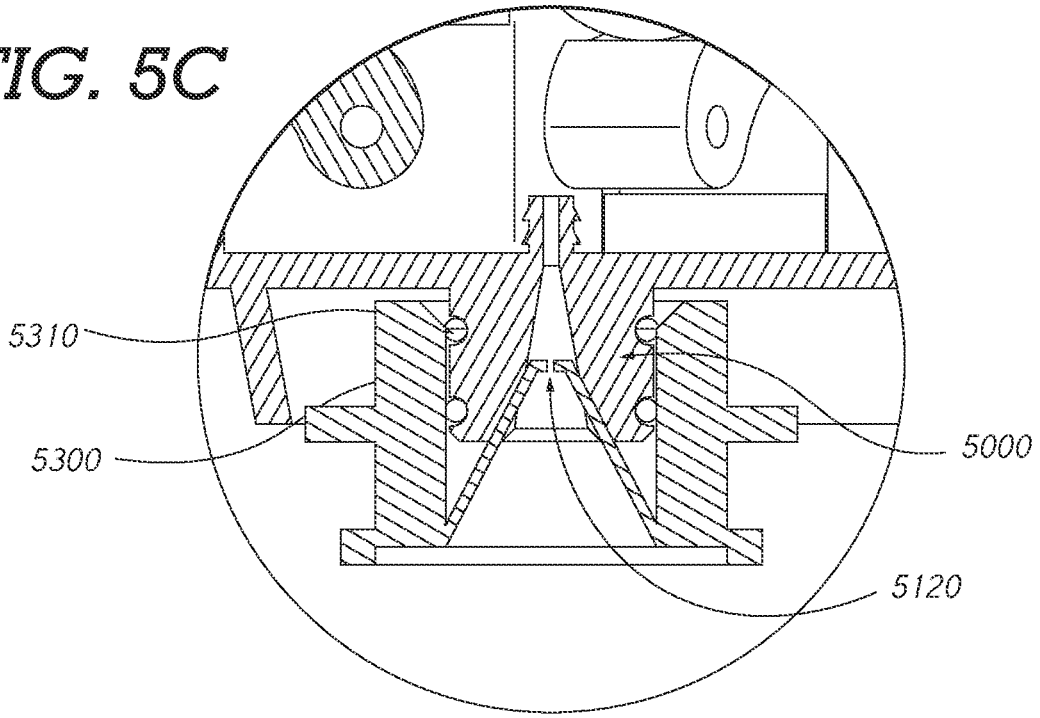

Certain embodiments of the present invention, as shown in FIG. 5A-FIG. 5C for example, comprise an apparatus 1000 having a vacuum pump 1100 and at least one gas-filled canister 1300 wherein the gas-filled canister 1300 and the vacuum pump 1100 are interconnected with the port 1200 of the apparatus where through the apparatus 1000 can draw air from within an interconnected container 2000 prior to back-filling with the gas from the gas-filled canister.

In certain embodiments, as shown in FIG. 5A-FIG. 5C for example, the port 1200 of an apparatus comprises a tube 5000 and a port 2200 of a container comprises at least one duck-bill valve 5100 disposed within a recess 5200, wherein the tube 5000 of the apparatus is configured to insert into the recess 5200 of the container, resulting in the opening of the duckbill valve 5100 to allow the pulling of vacuum and backfilling of gasses though the duckbill valve 5100.

In certain embodiments of the present invention, as shown in FIG. 5A-FIG. 5C for example, when the tube 5000 of the apparatus extends into the recess 5200, the distal end 5010 of the tube and depresses the sidewalls 5110 of the duck-bill valve downward and/or inward. Such deflection of the sidewalls 5110 of the duckbill valve results in the opening 5120 of the sealing elements of the duckbill valve. When an opening 5120 is created in the duckbill valve, the apparatus 1000 is interconnected with the container 2000 such that the apparatus 1000 can draw air from within the container, and supply gas to the container through the tube. In certain embodiments, a seal 5300 between the tube 5000 of the apparatus, and the recess 5200 of the container is created using O-rings 5310. It will be appreciated by those skilled in the art that embodiments comprising alternate connection strategies between the apparatus and a container are within the spirit and scope of the present invention.

Figure 6:
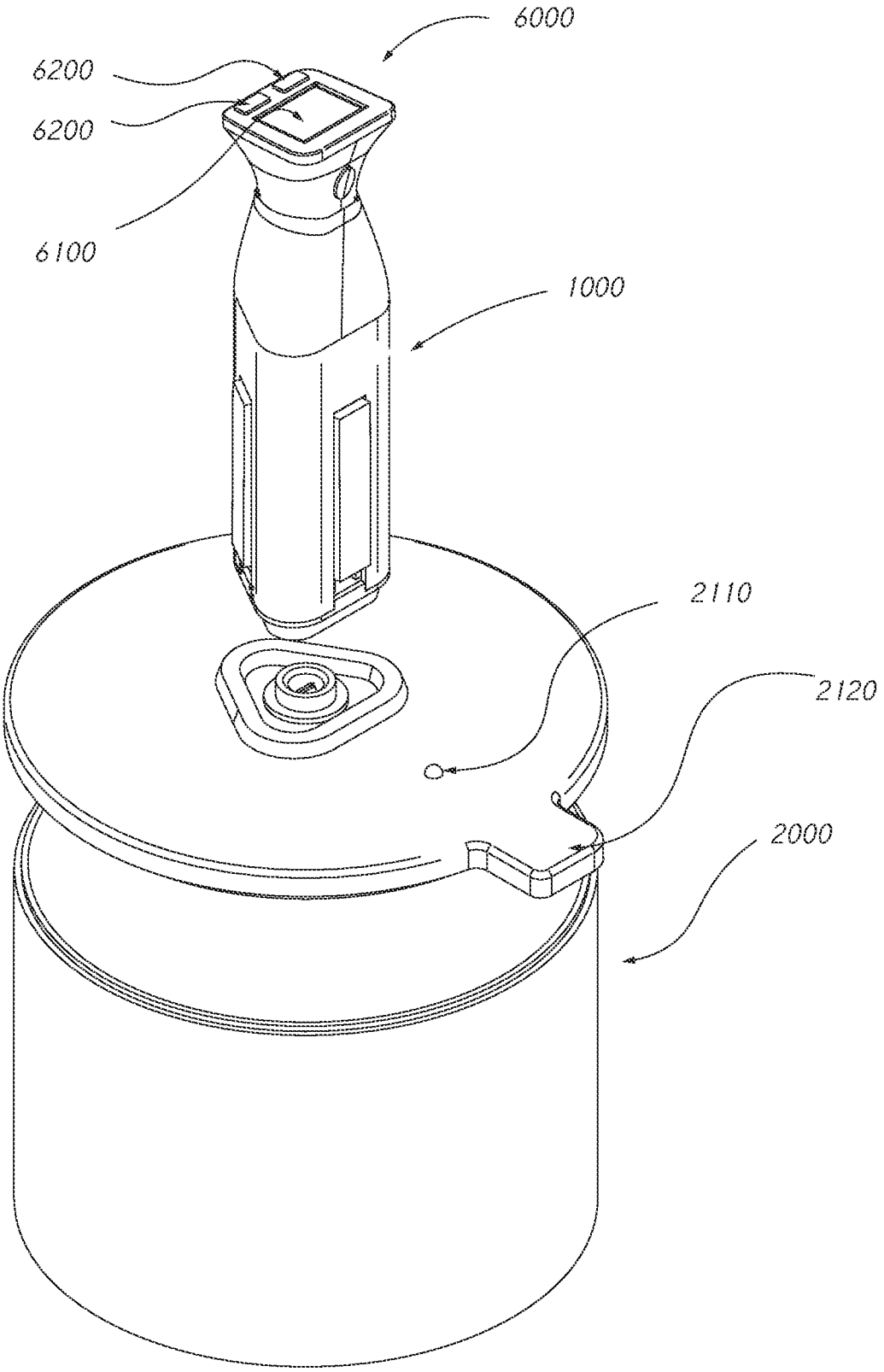

Certain embodiments of the present invention, as seen in FIG. 6 for example, comprise an apparatus 1000 having a user interface 6000 having a display 6100 and user inputs such as buttons 6200 wherein a user can select the type of product contained within the container 2000 to select the type of gas or gas mixture for backfilling into the container following pulling a vacuum.

Certain embodiments of the present invention, as shown in FIG. 6, comprise a container 2000 having a lid 2100 wherein the lid comprises a pressure release valve 2110. Actuation of the pressure release valve 2110 serves to equalize the pressure between the container 2000 and the ambient environment prior to the opening of the container 2000 such as when there is a negative relative pressure within the container 2000, thus equalizing the pressure between the container 2000 and the ambient pressure serves to make it easier for a user to remove the lid 2100 of the container. Certain embodiments comprise a lid having a tab 2120 providing further ease in the removal of the lid 2100 from the container 2000.

Figure 7:
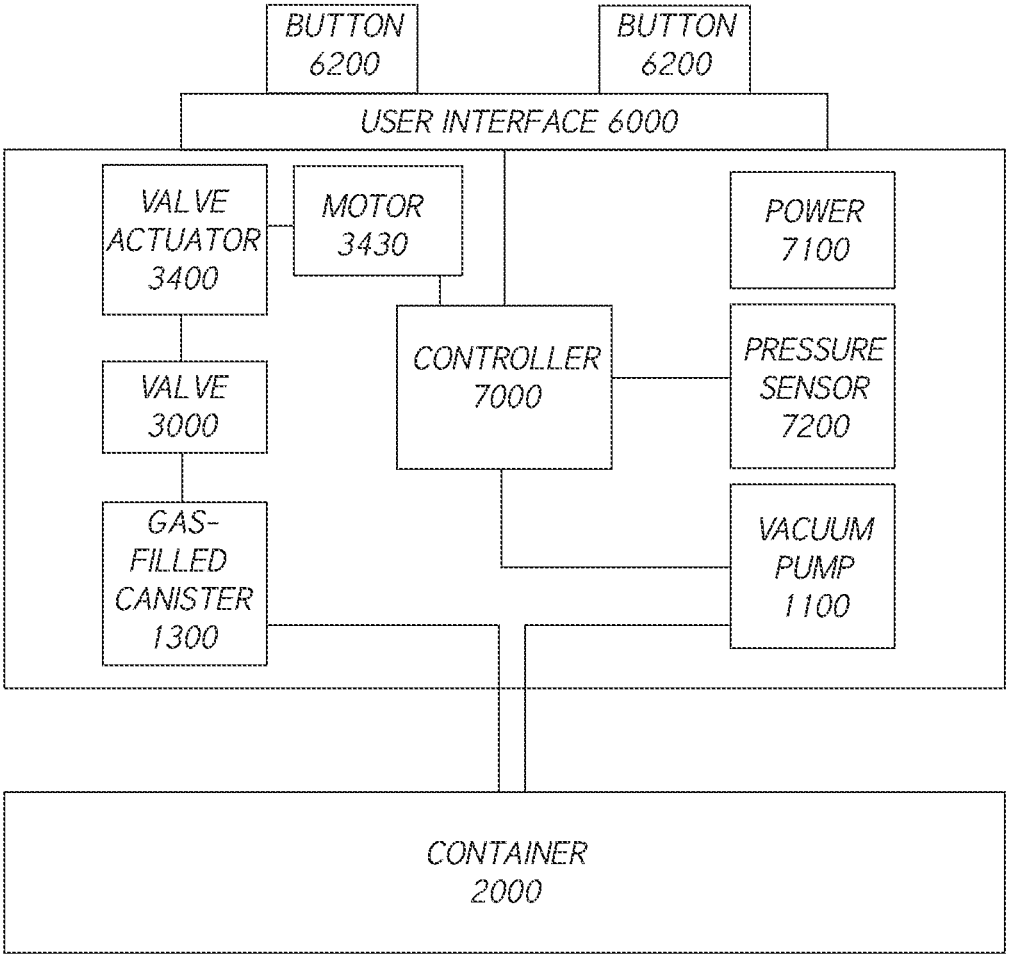

Certain embodiments of the present invention, as shown in FIG. 7 for example, comprise a method for modified atmosphere packaging using an apparatus 1000 having gasses contained in gas-filled canisters 1300 which are selectively used to fill a container 2000 with gasses intended to prolong the storage life of stored perishable goods. In certain embodiments, the apparatus 1000 comprises an internal controller 7000 connected to a power source 7100 and connected to user interface 6000 wherein a user can identify the goods contained within the container. After selecting the type of perishable goods contained within the container, the apparatus 1000—interconnected to the container 2000—draws a vacuum and then backfills the container with the selected gasses. In certain embodiments a negative pressure remains within the container to encourage a complete seal and longer lasting seal. Certain embodiments of an apparatus comprises a pressure sensor 7200 wherein the apparatus 1000 actuates the vacuum pump 1100 to a draw a vacuum until a desired negative pressure is achieved within the container prior to back-filling the container 2000 with at least one gas from a gas-filled canister 1300. Certain embodiments comprise a backfilling step to backfill the container 2000 with at least one gas from a gas-filled canister 1300, and terminating the back-filling step, leaving a negative pressure within the container 2000 in relation to ambient environment. The backfilling step is initiated by actuating at least one valve 3000, thereby releasing a gas from at least one gas-filled canister 1300. It will be appreciated however, that embodiments backfilling the container 2000 with at least one gas from a gas-filled canister to a positive pressure in relation to ambient environment is in keeping with the spirit and scope of the present invention.

Figure 8:
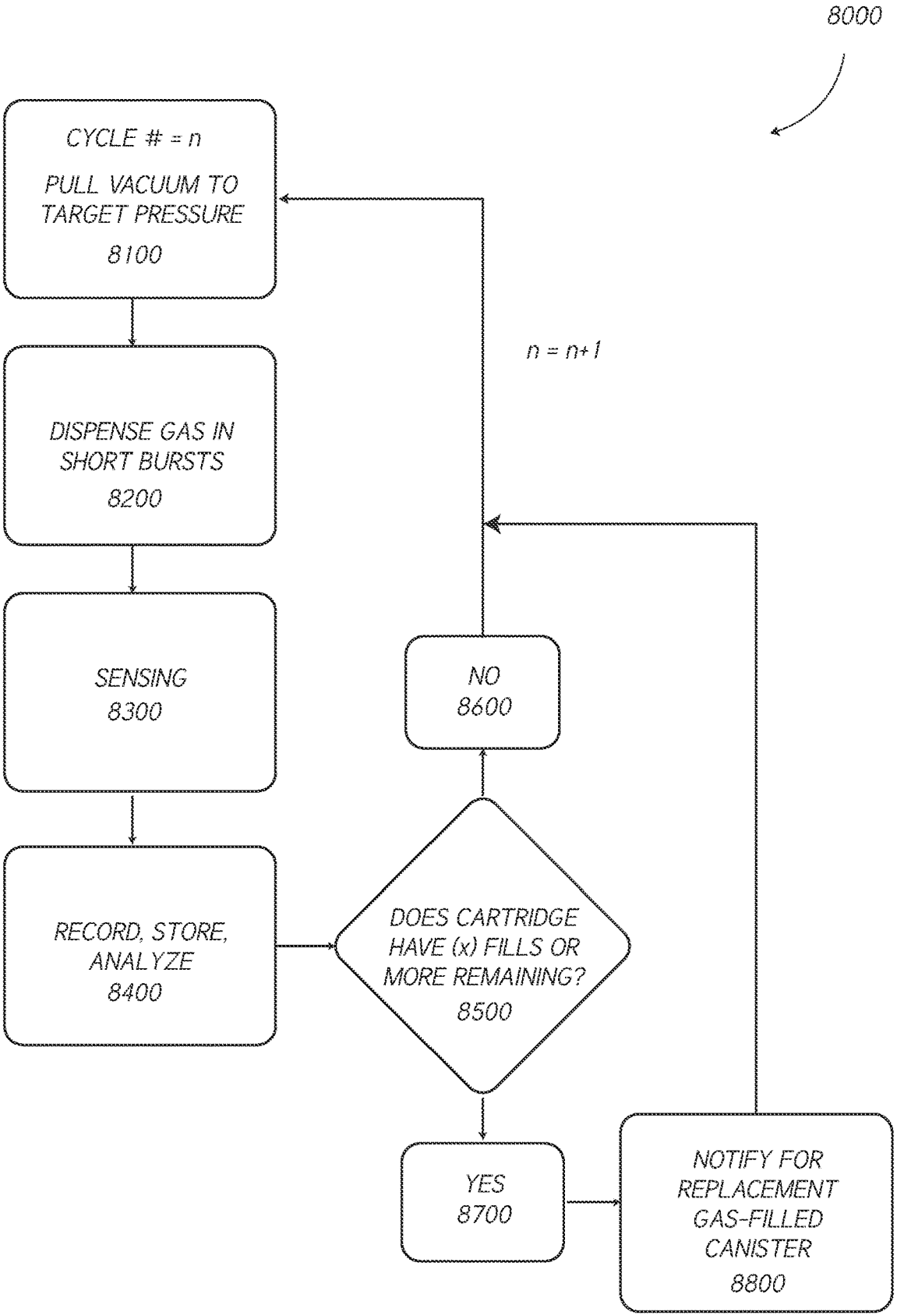

In certain embodiments, as shown in FIG. 8, the present invention comprises a method for the determination of the amount of gas fill cycles (x) remaining within a gas-filled canister after a number of cycles (n) executed. In each cycle (n) a vacuum is pulled 8100 within the container with the vacuum pump to a predetermined target pressure, while the vacuum is continued to be pulled, a short burst (or bursts) of gas 8200 is dispensed from the gas-filled canister. During the simultaneous pulling of vacuum and dispensing of short bursts of gas, a pressure sensor senses 8300 the effect of the short bursts on the internal pressure maintained within the container. As the remaining gas within the gas-filled canister decreases, the effect of the dispensing of short bursts of gas have a diminishing effect on the overall pressure held within the container. The diminishing effect is monitored, recorded, and analyzed 8400 for trends through each proceeding cycle (n+1) of dispensing gasses that the system determines 8500 the estimated number of gas fill cycles remaining until a total number of gas-fills (n+x) are reached. In certain embodiments if it is determined that there are more than (x) number of fills remaining 8600, the proceeding cycle is continued with no action. However, if it is determined that (x) number of fills or less remain 8700, the system provides a notification 8800 that a new gas-filled canister will be required. It will be appreciated that a notification as disclosed herein can include a visual notification to the user, an audible notification to the user, an electronic notification to the user, or the automatic ordering of a new gas-filled canister from a supplier on behalf of the user. Such automatic orderings can be performed in a number of ways known to those skilled in the art. For instance, an automatic order can be placed as a direct order sent directly to the supplier on behalf of the user, or the automatic order can be placed through a cloud-based system for fulfillment by one particular supplier, or multiple suppliers. It will be further appreciated that an automatic ordering can be performed by adding a replacement gas-filled canister into a user's cloud-based shopping cart to allow the user to execute the order through an online portal such as described in U.S. Pat. No. 8,751,405 to Ramaratnam et al. ("Ramaratnam"), incorporated in its entirety herein by reference for all purposes.

Figure 9:
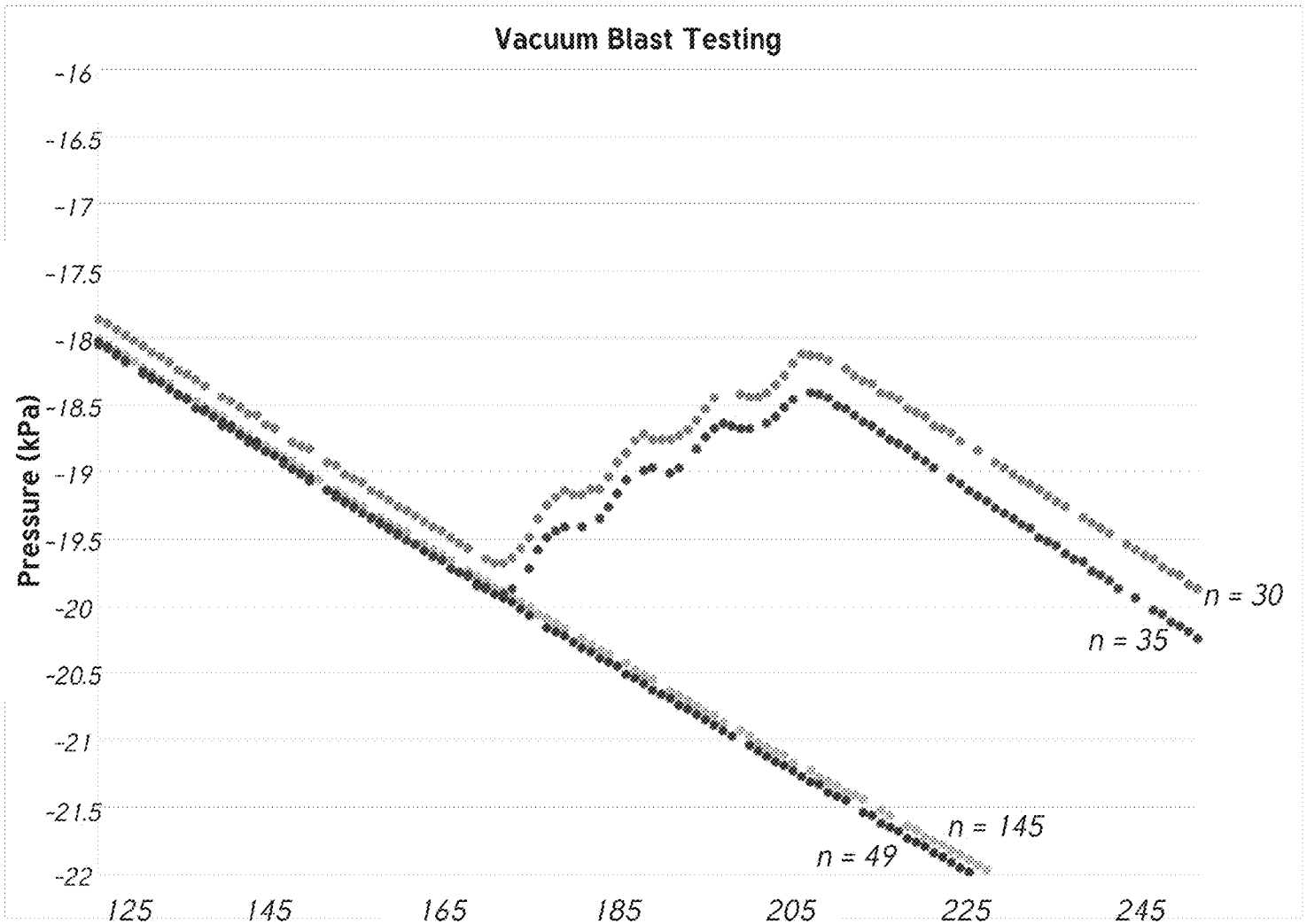

For instance, as shown in FIG. 9, the emergent characteristic the effect of short gas bursts on the pressure within the container changes when the gas-filled canister approaches depletion. When the effect of the short burst sequence has deteriorated to a negligible effect, this indicates that the gas-filled canister nearing the end of its life. In the example as shown, the pressure effect of the short burst sequence deteriorates between cycle n=35 in comparison to cycle n=30. After n=49 cycles of the shown example using of four short bursts while pulling a vacuum, the short bursts no longer have an identifiable effect on the pressure within the container. Thus, it is perceived that the gas canister is depleted or nearing depletion. It is the monitoring of the deterioration of this effect that is performed to characterize the remaining life span of the gas-filled canister. It will be appreciated that although embodiments described herein use four short bursts, alternative embodiments using fewer or more short bursts during the short burst sequence can be used and monitored in determining the cycles remaining for dispensing within a gas-filled canister.

Figure 10:
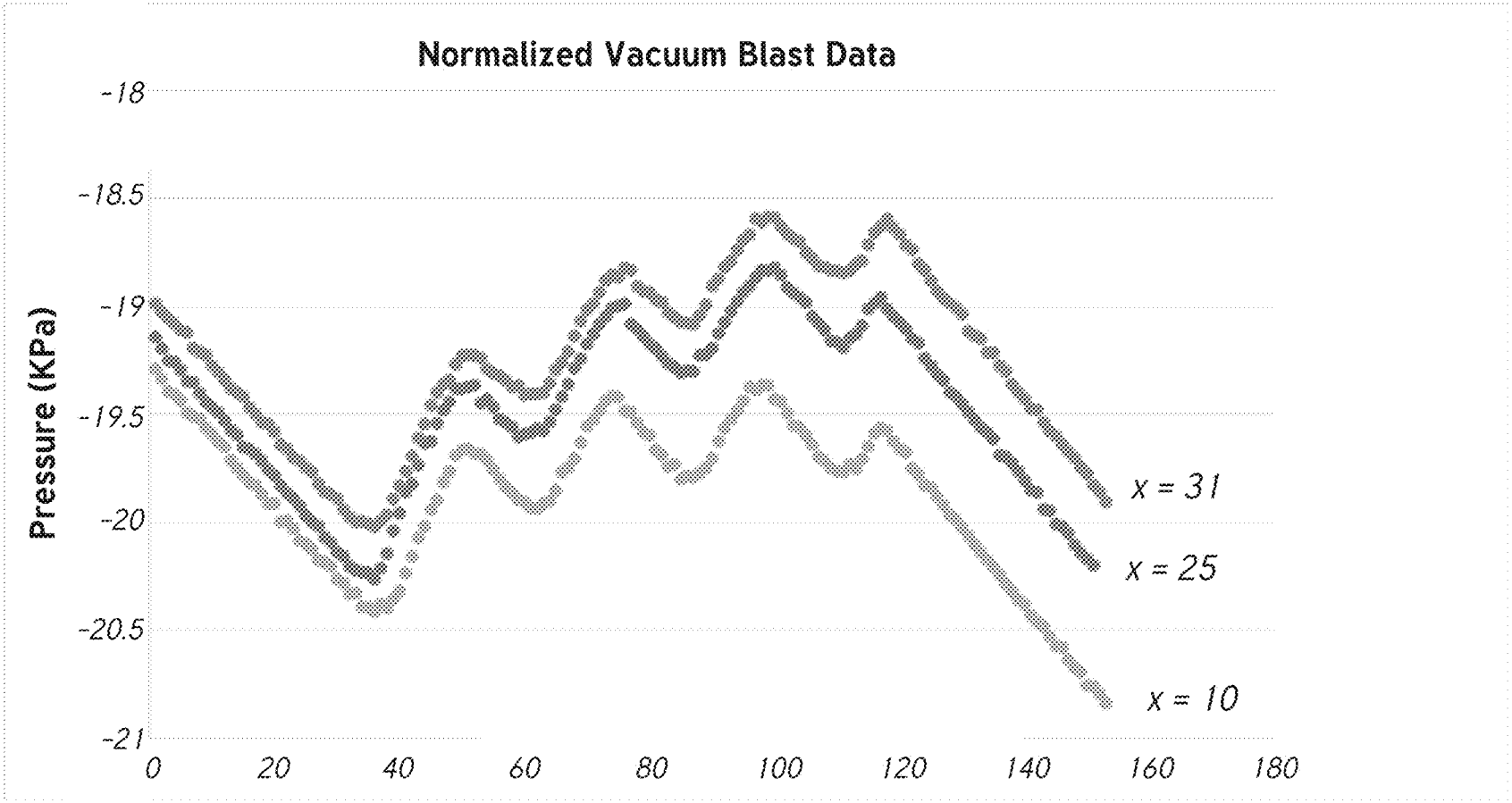

In certain embodiments, such as shown in FIG. 10, wherein each cycle (n) receives a series of gas bursts which dispense a predetermined amount of gas for each cycle (n), the deterioration of the effect of the gas bursts can be seen between x=31 cycles remaining, x=25 cycles remaining, and x=10 cycles remaining. The deterioration of effect of the gas bursts while pulling a vacuum are indicative of a depleting gas-filled canister. Such data is stored and analyzed for the purposes of identifying deteriorating trends to calculate the predicted number of cycles (x) remaining for use in the gas-filled canister.

Figure 11:
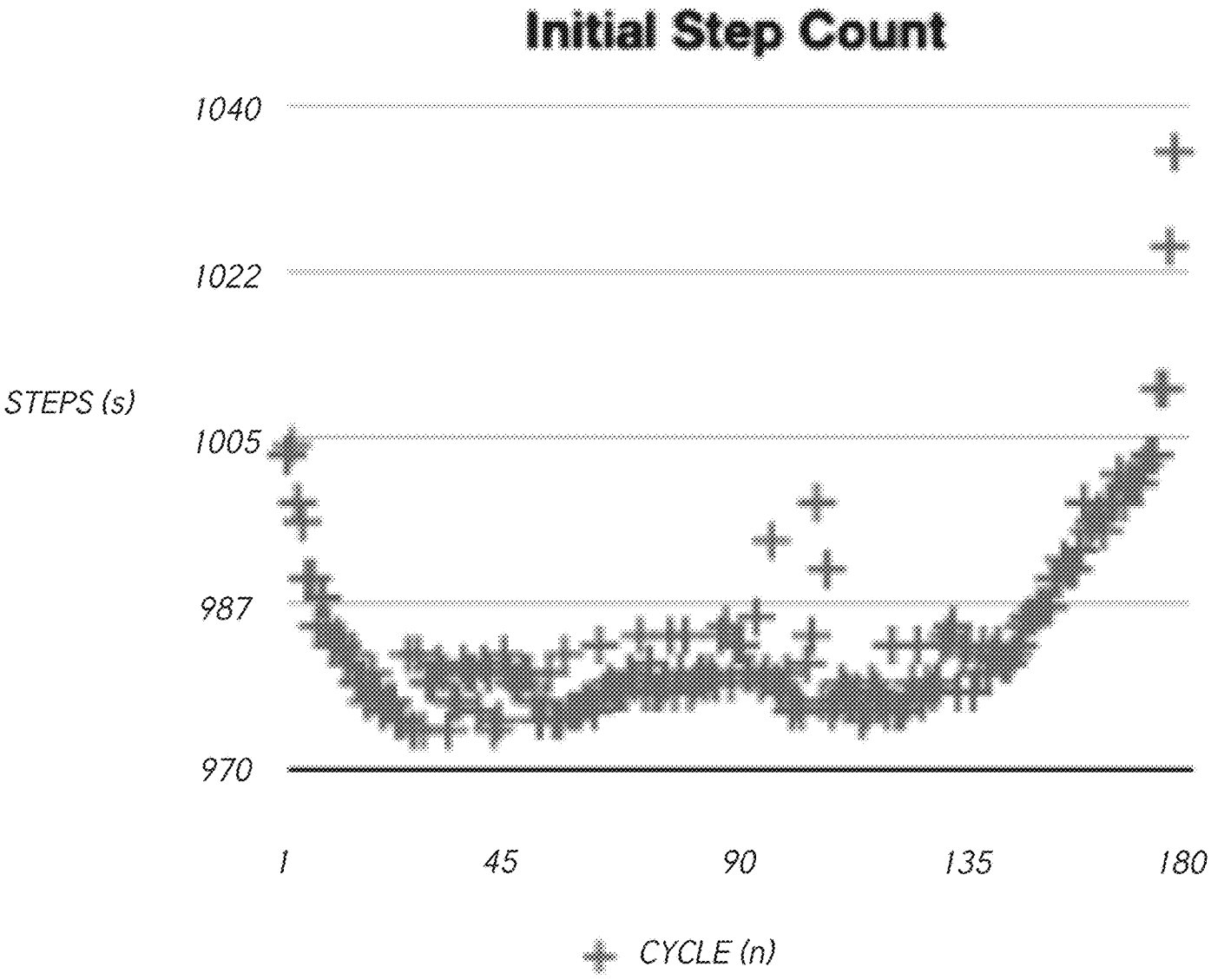

In certain embodiments, the remaining gas-fill cycles (x) can be calculated based on the emergent properties of the system after (n) cycles as shown in FIG. 11, wherein the number of motor steps (s) required of the electro-mechanical motor to dispense gasses are recorded. In each proceeding cycle (n+1), the controller records the number of motor steps (s) required to dispense gasses over a predetermined length of time to a predetermined target pressure within the container. The number of motor steps (s) required are recorded, stored, and analyzed in comparison to previous cycles. Based on the emergent properties of certain embodiments, the number of motor steps required to dispense gasses in the first cycles are greater than following cycles. Reasons for such properties as shown can be attributed to phenomena such as, but not limited to, choked flow conditions. The number of motor steps (s) progressively decreases with each following cycle until an equilibrium is reached wherein the number of motor steps (s) required to dispense gasses remain consistent. As the gas-filled canister nears depletion, the number of motor steps (s) required to dispense the gasses in the predetermined amount of time to a predetermined target pressure increase at a repeatable rate. In certain embodiments, as shown in FIG. 11, the increase in motor steps (s) required is linear. It is upon the identification of this repeatable increase of motor steps (s) following equilibrium that it can be determined that (x) number of gas-fill cycles remain. Furthermore, it is with the identification of the repeatable increase of motor steps (s) that a notification 8800 can be generated for the replacement of the gas-filled canister.

In certain embodiments, a spring 3422 (FIG. 2C) with a known spring rate is placed between the pin 3420 and the extension arm 3220. It will be appreciated that when the pressure within the gas-filled canister is high, the spring 3422 will compress and require a higher number of motor steps (s) to dispense gasses from the canister. However, as the pressure within the gas-filled canister decreases, the spring is less compressed during the dispensing of gasses, and thus the electro-mechanical motor requires fewer motor steps to dispense gasses from within the gas-filled canister. Therefore, it will be appreciated by one skilled in the art that the monitoring of step count of the electro-mechanical motor can be used to monitor spring compression which directly relates to the gas pressure held within the gas-filled canister, thus mitigating the effects of complex flow conditions such as choked flow.

It will be appreciated to those skilled in the art that common statistical methods of data analysis of deterioration of gas dispensing effects as measured and disclosed above can be used in the above identified example datasets when recording, storing, and analyzing the effect of dispensing gasses in bursts, or tracking the number of motor steps required to dispense gasses.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A system for modified atmosphere packaging comprising:

an apparatus comprising:

a vacuum pump interconnected to a port;

a receiver configured to interconnect to at least one gas-filled canister;

the receiver comprises a valve configured control release of pressurized gas;

the valve interconnected with the port of the apparatus, wherein interconnection of an outlet end of the at least one gas-filled canister to the receiver and actuation of the valve results in flow of the pressurized gas through the valve which flows out through the port of the apparatus; and a container lid comprising a port, and a one-way valve interconnected with the port of the container lid, wherein the port of the apparatus is configured to interconnect with the port of the container lid, wherein pulling of a vacuum with the vacuum pump results in pulling of the vacuum through the port of the apparatus, wherein when the port of the apparatus is interconnected with the port of the container lid, wherein the apparatus is configured to pull the vacuum and dispense the pressurized gas through the port of the apparatus through the port of the container lid to modify atmosphere contained within a container to which the container lid is interconnected.

2. The apparatus of claim 1 further comprising a pressure sensor.

3. The system of claim 1, wherein the one-way valve comprises a duck-bill valve.

4. The system of claim 3, wherein the port of the apparatus is configured to deflect sidewalls of the duck-bill valve inward when the port of the apparatus is interconnected with the port of the container lid, resulting in the sealing element of the duck-bill valve opening.

5. The system of claim 1, wherein container lid configured to seal a container, and wherein the container lid is configured to be removably interconnected with the container.

6. The system of claim 5 wherein the apparatus is able to simultaneously pull the vacuum and allow the flow of the pressurized gas through the port of the apparatus simultaneously.

7. An apparatus for modified atmosphere packaging comprising:

a vacuum pump interconnected to a port;

a receiver configured to interconnect to at least one gas-filled canister;

the receiver comprises a valve configured to control release of pressurized gas;

the valve interconnected with the port of the apparatus, wherein interconnection of an outlet end of the at least one gas-filled canister to the receiver and actuation of the valve results in flow of the pressurized gas through the valve and through the port of the apparatus, wherein pulling of a vacuum with the vacuum pump results in pulling of the vacuum through the port of the apparatus;

the valve comprises a cam constrained to the valve by a pivot, the cam having an extension arm on a first side of the pivot, and a lobe on a second side of the pivot; and the valve further comprises a spring-loaded follower adjacent to the lobe, wherein the spring-loaded follower is interconnected with the at least one gas-filled canister;

wherein rotation of the cam in a first direction results in the lobe depressing the spring-loaded follower, and wherein the spring-loaded follower is configured to release the pressurized gas from the at least one gas-filled canister interconnected with the receiver when the spring-loaded follower is depressed.

8. The apparatus of claim 7, further comprising a valve-actuator affixed by a pivot, the valve-actuator further comprising at least one pin configured to contact and rotate the cam when the valve-actuator is rotated about the pivot of the valve-actuator; and an electro-mechanical motor interconnected to the valve-actuator, wherein rotation of the electro-mechanical motor in a first direction rotates the valve-actuator in a first direction, which rotates the cam in the first direction, resulting in the lobe depressing the spring-loaded follower, thus opening the valve and releasing the pressurized gas from the at least one gas-filled canister.

9. The apparatus of claim 8, wherein the receiver comprises a plurality of valves configured to receive the outlet end of a plurality of gas-filled canisters, wherein each of the plurality of valves comprises a cam, and wherein each of the cams comprises a lobe.

10. The apparatus of claim 9, wherein the at least one pin of the valve-actuator comprises a plurality of pins configured to contact and rotate the cams when the valve-actuator is rotated about the pivot of the valve-actuator;

wherein the rotation of the electro-mechanical motor in the first direction rotates the valve-actuator in the first direction, which rotates a cam of a first valve in a first direction, resulting in a lobe of the cam of the first valve depressing the spring-loaded follower of the first valve and releasing the pressurized gas from a first gas-filled canister interconnected to the first valve, and wherein the rotation of the electro-mechanical motor in a second direction rotates the valve-actuator in a second direction, which rotates a cam of a second valve in a second direction, resulting in a lobe of the cam of the second valve depressing the spring-loaded follower of the second valve and releasing gas from a second gas-filled canister interconnected to the second valve.

11. The apparatus of claim 10 further comprising at least one receptacle configured to hold a gas-filled canister therein.

12. The apparatus of claim 11, wherein the at least one receptacle comprises a door hingedly attached thereto, the door comprising a cam on an internal aspect;

the cam of the door comprises a lobe wherein rotative closing of the door rotates the lobe of the cam of the door toward the recess, thereby moving the gas-filled canister to interconnect the outlet end of the gas-filled canister with the valve.

13. The apparatus of claim 12, wherein the at least one receptacle further comprises' g a plurality of receptacles.

14. A method to determine the amount of gas remaining within a gas-filled canister interconnected to an apparatus for modifying atmosphere within a sealable container comprising the following steps:

interconnecting a port of the apparatus to a port of the container;

pulling a vacuum within the container;

while pulling the vacuum, actuating a valve configured to control release of a gas from the gas-filled canister;

dispensing the gas from the gas-filled canister through the port of the apparatus, through the port of the container, and into the container;

sensing pressure within the container;

recording the pressure information sensed during the dispensing step;

storing the pressure information;

analyzing the pressure information in comparison to previous cycles; and determining how many cycles of gas dispensing remain within the gas-filled canister, wherein if the number of cycles remaining is less than a predetermined number of cycles, a notification is generated for a replacement of the gas-filled canister.

15. The method of claim 14, wherein the dispensing step comprises a series of short bursts of the gas.

16. The method of claim 14, wherein the recording step further comprises recording of a number of motor steps required by the electro-mechanical motor to dispense a predetermined amount of the gas within a predetermined amount of time.

17. The method of claim 16, wherein the number of motor steps is analyzed in view of a previous number of motor steps required in the previous cycles.

18. The method of claim 17, wherein when the number of motor steps increase, a notification is generated for the replacement of the gas-filled canister.

19. An apparatus for modified atmosphere packaging comprising:

a vacuum pump interconnected to a port, wherein pulling of a vacuum results in the pulling of the vacuum through the port;

three receptacles each configured to hold therein a gas-filled canister having a closed end and an outlet end;

a receiver having three valves each configured to interconnect with the outlet end of each gas-filled canister;

each receptacle comprising a door hingedly attached thereto comprising a cam on an internal aspect of the door, the cam having a lobe;

each valve configured to interconnect with the outlet end of the gas-filled canister to control release of a gas contained within the gas-filled canister;

each valve comprises a cam constrained to the valve by a pivot, the cam having an extension arm on a first side of the pivot, and a lobe on a second side of the pivot;

each valve further comprises a spring-loaded follower adjacent to the lobe;

each valve further comprising a connection to the port, wherein the release of the gas from the gas-filled canisters flows out through the port;

a valve-actuator affixed by a pivot centered between the valves, the valve-actuator further comprising a plurality of pins configured to contact and rotate the cams when the valve-actuator is rotated about the pivot of the valve-actuator, wherein rotative opening of the door allows placement of the closed end of the gas-filled canister in the receptacle, wherein rotative closing of the door rotates the gas-filled canister to align the outlet end of the gas-filled canister with the valve, and rotates the lobe of the cam toward the valve, thereby moving the gas-filled canister to interconnect the outlet end of the gas-filled canister with the valve, wherein rotation of the valve-actuator in a first direction rotates at least one lever in the first direction, resulting in the cam depressing the spring-loaded follower, thus opening the valve and releasing the gas from the gas-filled canister, and wherein the rotation of the valve-actuator in a second direction rotates the cam in the second direction, resulting in the cam releasing the spring-loaded follower, thus closing the valve and terminating the release of the gas from the gas-filled canister.

* * * * *